US006435904B1

(12) United States Patent
Herbst et al.

(10) Patent No.: US 6,435,904 B1
(45) Date of Patent: Aug. 20, 2002

(54) MULTIPLE PERIPHERAL CONNECTION DEVICE FOR CONNECTING MULTIPLE PERIPHERAL DEVICES TO A HOST DEVICE

(75) Inventors: John E. Herbst, Streamwood; James W. Beile, Arlington Heights; Megan Hayes, DesPlaines; Gregory J. Foster; Robert W. Sheldon, both of Chicago, all of IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 09/870,983

(22) Filed: Jun. 1, 2001

(51) Int. Cl.[7] ..... H01R 13/60
(52) U.S. Cl. ..... 439/534; 439/535
(58) Field of Search ..... 439/534, 162, 439/164, 535

(56) References Cited

U.S. PATENT DOCUMENTS

| | | | | |
|---|---|---|---|---|
| 4,171,855 A | | 10/1979 | Raskin | |
| 4,850,880 A | | 7/1989 | Zayat, Jr. et al. | |
| 4,986,762 A | * | 1/1991 | Keith | 439/534 |
| 5,316,499 A | | 5/1994 | Scannelli et al. | |
| 5,542,850 A | | 8/1996 | Frantz | |
| 5,639,261 A | | 6/1997 | Rutkowski et al. | |
| 5,681,171 A | | 10/1997 | Park | |
| 5,772,447 A | | 6/1998 | Cheung | |
| 5,967,836 A | | 10/1999 | Bailey | |
| 5,984,720 A | * | 11/1999 | Milner et al. | 439/534 |
| 6,000,042 A | | 12/1999 | Henrie | |
| 6,011,486 A | | 1/2000 | Casey | |
| D421,962 S | | 3/2000 | Varga | |
| 6,050,849 A | | 4/2000 | Chang | |
| D425,866 S | | 5/2000 | Nagasawa et al. | |
| 6,058,441 A | | 5/2000 | Shu | |
| 6,064,554 A | | 5/2000 | Kim | |
| 6,105,143 A | | 8/2000 | Kim | |
| 6,141,221 A | | 10/2000 | Tong et al. | |
| 6,170,062 B1 | | 1/2001 | Henrie | |
| 6,178,513 B1 | | 1/2001 | Lee | |

* cited by examiner

*Primary Examiner*—Gary F. Paumen
(74) *Attorney, Agent, or Firm*—Pillsbury Winthrop LLP

(57) ABSTRACT

The present invention relates to a multiple peripheral connection device for connecting multiple peripheral devices to a host device via a series of flexible electrical connectors. The device includes a multiplicity of port orienting structures having downstream ports provided thereon. The port orienting structures are individually movable relative to the device housing and one another so as to enable relative orientation of said downstream ports provided thereon to be adjusted to facilitate establishing the electrical coupling between the downstream ports and the multiple peripheral devices.

38 Claims, 3 Drawing Sheets

MULTIPLE PERIPHERAL CONNECTION DEVICE FOR CONNECTING MULTIPLE PERIPHERAL DEVICES TO A HOST DEVICE

FIELD OF THE INVENTION

The present invention relates to a multiple peripheral connection device for connecting multiple peripheral devices to a host device.

BACKGROUND OF THE INVENTION

Multiple peripheral connection devices are known in the art for connecting a plurality of peripheral devices, such as a scanner, printer, or computer mouse, to a host device, such as the CPU of a computer. These devices typically comprise a housing, an upstream port for electrically connecting to the host device, a plurality of downstream ports for electrically connecting to the peripheral devices, and a hub electrically coupling the upstream ports with the downstream ports. Flexible cables are used to establish the connections between the ports and the host device and peripheral devices. The hub enables data to be transferred between the host device and the peripheral devices via the upstream and downstream ports. The hub normally manages the data transfer in accordance with a standard protocol, such as the well-known USB protocol.

In these known devices, the locations of the downstream ports is fixed with respect to the housing. As a result, the user may find it difficult or awkward to connect the flexible cables from the peripheral devices to the downstream ports when the peripheral devices are in varying locations. Specifically, if the user needs to connect one of the cables to a port that is not facing towards the peripheral device, the cable has to be bent around the device and connected to the port. If the connection device is in a visible location (e.g., on a desktop), the resulting appearance is poor because of the manner in which the cables connect to the downstream ports.

SUMMARY OF THE INVENTION

To obviate the problems described above, the present invention provides a multiple peripheral connection device for connecting multiple peripheral devices to a host device via a series of flexible electrical connectors. The device comprises a housing; an upstream port adapted to be electrically connected to a flexible electrical connector that electrically connects to the host device so as to electrically couple the upstream port to the host device; and a plurality of downstream ports each adapted to be electrically connected to a flexible electrical connector that electrically connects to a peripheral device so as to electrically couple the downstream ports to the multiple peripheral devices. A hub electrically couples the upstream port to the downstream ports. The hub enables data signals to be transferred between the host device and the multiple peripheral devices via the upstream ports and the downstream ports. A multiplicity of port orienting structures have the downstream ports provided thereon. The port orienting structures are individually movable relative to the housing and one another so as to enable relative orientations of the downstream ports provided thereon to be adjusted to facilitate establishing the electrical coupling between the downstream and ports and the multiple peripheral devices via the flexible electrical connectors.

Other objects, features, and advantages of the present invention will become apparent from the following detailed description, the accompanying drawings, and the appended claims.

DETAILED DESCRIPTION OF THE INVENTION

Figure 1:
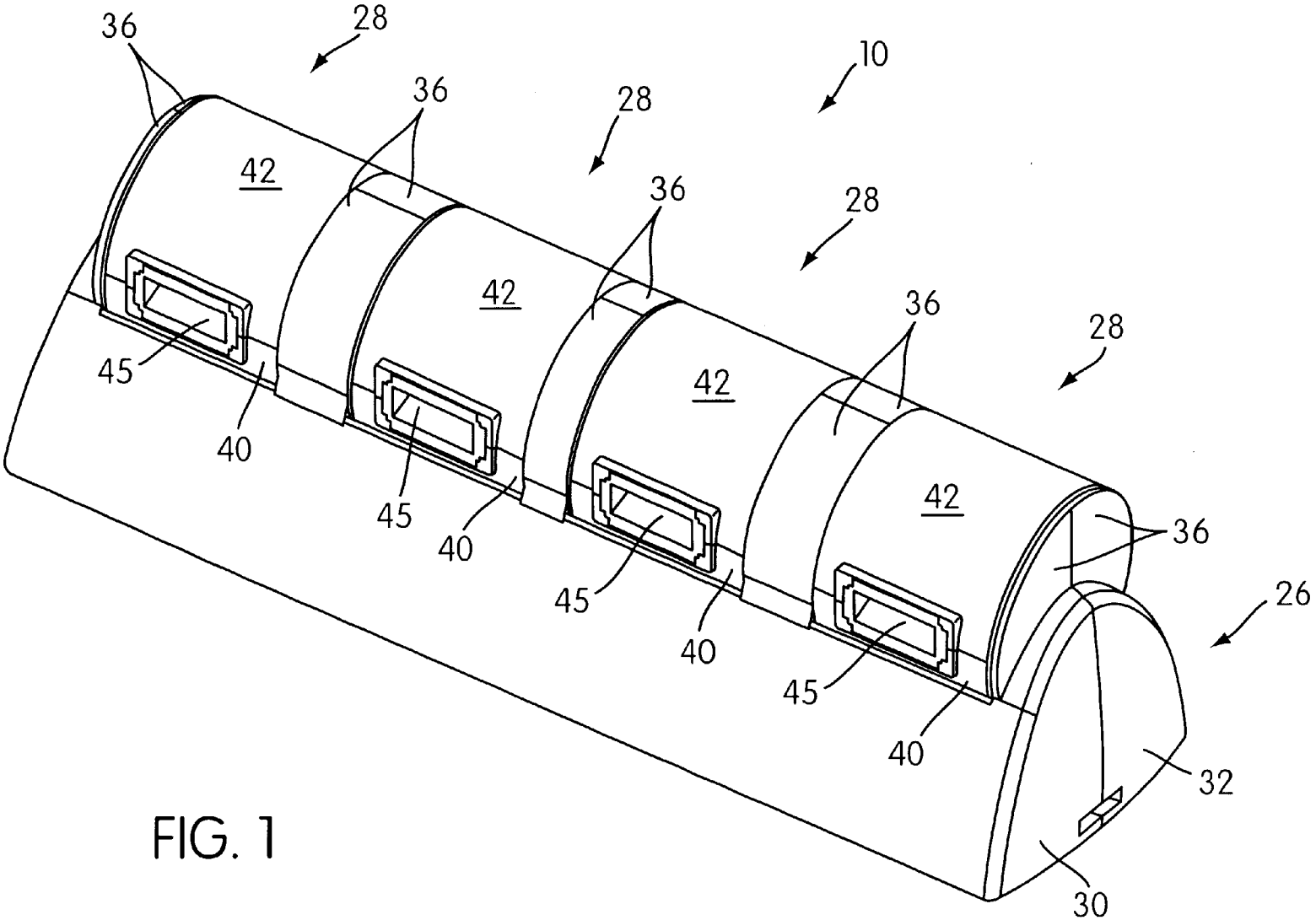
FIG. 1 is a perceptive view of a multiple connection device embodying the present invention.

FIG. 1 illustrates a multiple peripheral connection device, generally indicated at 10, constructed in accordance with the present invention. The device 10 enables multiple peripheral devices 12 to be connected to a host device 14, as shown schematically in FIG. 2. The host device 14 is typically a computer, such as a desktop or laptop computer, driven by a microprocessor. The peripheral device 12 may be any type of device designed for use with the host device 14. For example, the peripheral devices 12 may include functional devices, such as, input devices (i.e., a keyboard, mouse or joystick); a scanner; a read/write or read-only CD-ROM drive; a printer; a modem, or any other device that is connectable to the host device 14. Further, one or more of the peripheral device 12 may be another multiple peripheral connection device, thus increasing the number of functional peripheral devices that can be connected to the host device 14.

Figure 2:
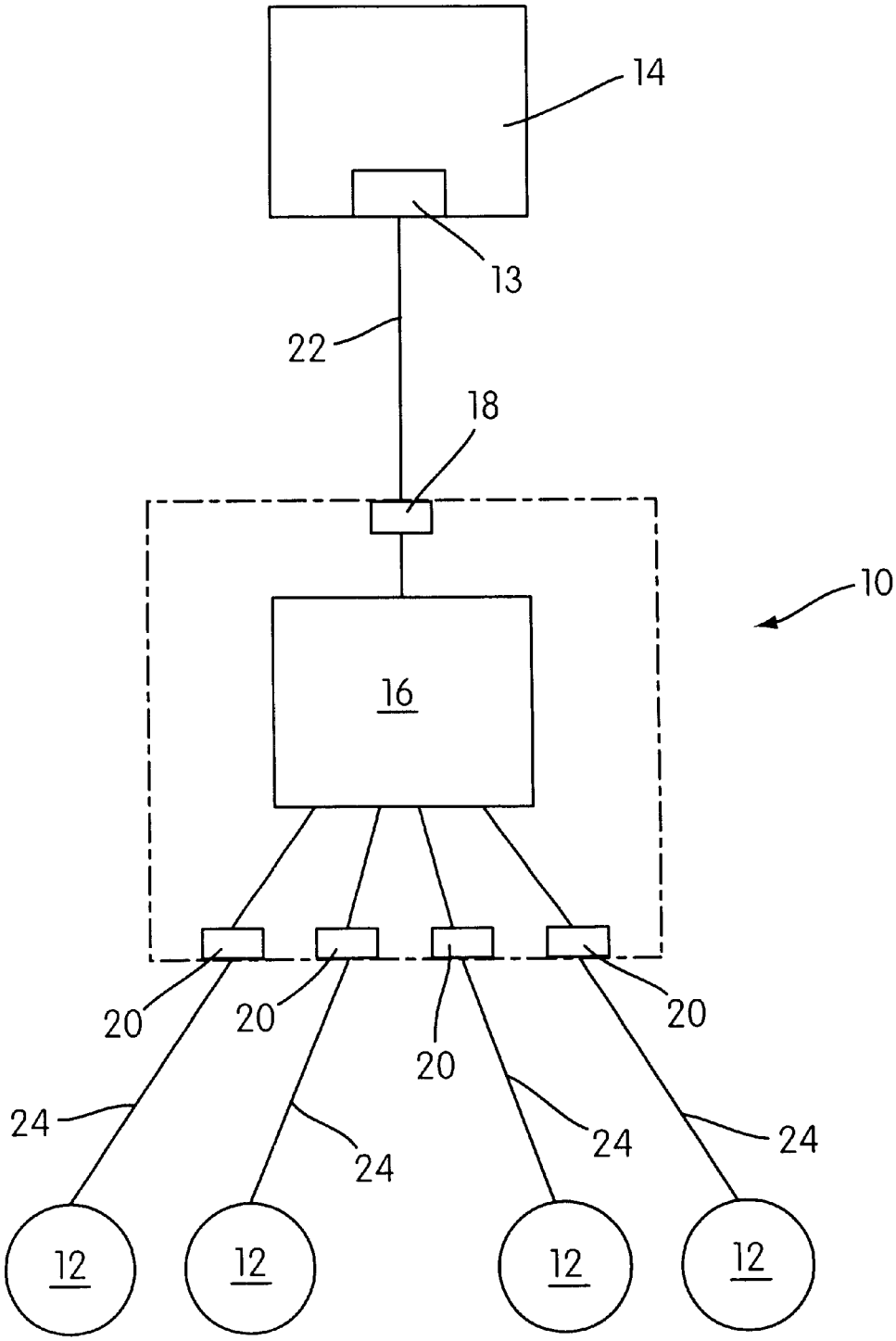
FIG. 2 is a schematic illustration of the manner in which the device of FIG. 1 connects multiple peripheral devices to a host device.

FIG. 2 schematically illustrates the manner in which the device 10 connects the multiple peripheral devices 12 to the root hub 13 of the host device 14 and the resulting bus system. The device 10 includes a hub 16, an upstream port 18, and a plurality of downstream ports 20. The upstream port 18 is adapted to be electrically connected to a flexible electrical cable 22 that electrically connects to the host device 14 so as to electrically couple the upstream port 18 to the host device 14. The downstream ports 20 are each adapted to be electrically connected to a flexible cable 24 that electrically connects to a peripheral device 12 so as to electrically couple the downstream ports 20 to the peripheral device 12.

The hub 16 electrically couples the upstream port 18 to the downstream ports 20 and enables data signals to be transferred between the host device 14 and the multiple peripheral device 12 via the upstream and the downstream ports 18, 20. Preferably, the hub 16 enables the data signals to be routed from the host device 14 to a selected subset of the multiple peripheral devices in accordance with any type of data transfer protocol, such as a serial data transfer protocol. This routing is controlled by a hub controller (not shown) that determines which peripheral(s) data is to be routed to/from based on data received from the host device. Of course, the host device 14 and the peripheral devices 12 are configured to communicate with one another in accordance with the same data transfer protocol. The preferred data transfer protocol is the well-known Universal Serial Bus (USB) protocol, which is detailed in the Universal Serial Bus Specifications, Revisions 2.0, dated Apr. 27, 2000, the entirety of which is hereby incorporated into the present application by reference. In accordance with the USB protocol, the hub 16 will have a hub repeater section, a hub controller and a transaction translator which function as detailed in the Universal Serial Bus Specifications. Also, the hub 16 may be capable of routing power supply signals to the multiple peripheral device 12 so that the multiple peripheral devices 12 can draw power from the host device 14 via the hub 16. However, other data transfer protocols, such as the RS-232 protocol may also be used. Because the present invention is not specifically concerned with the manner in which data transfer is affected, but instead is concerned with the physical construction of the device 10 itself, further details of such data transfer will not be provided.

Figure 3:
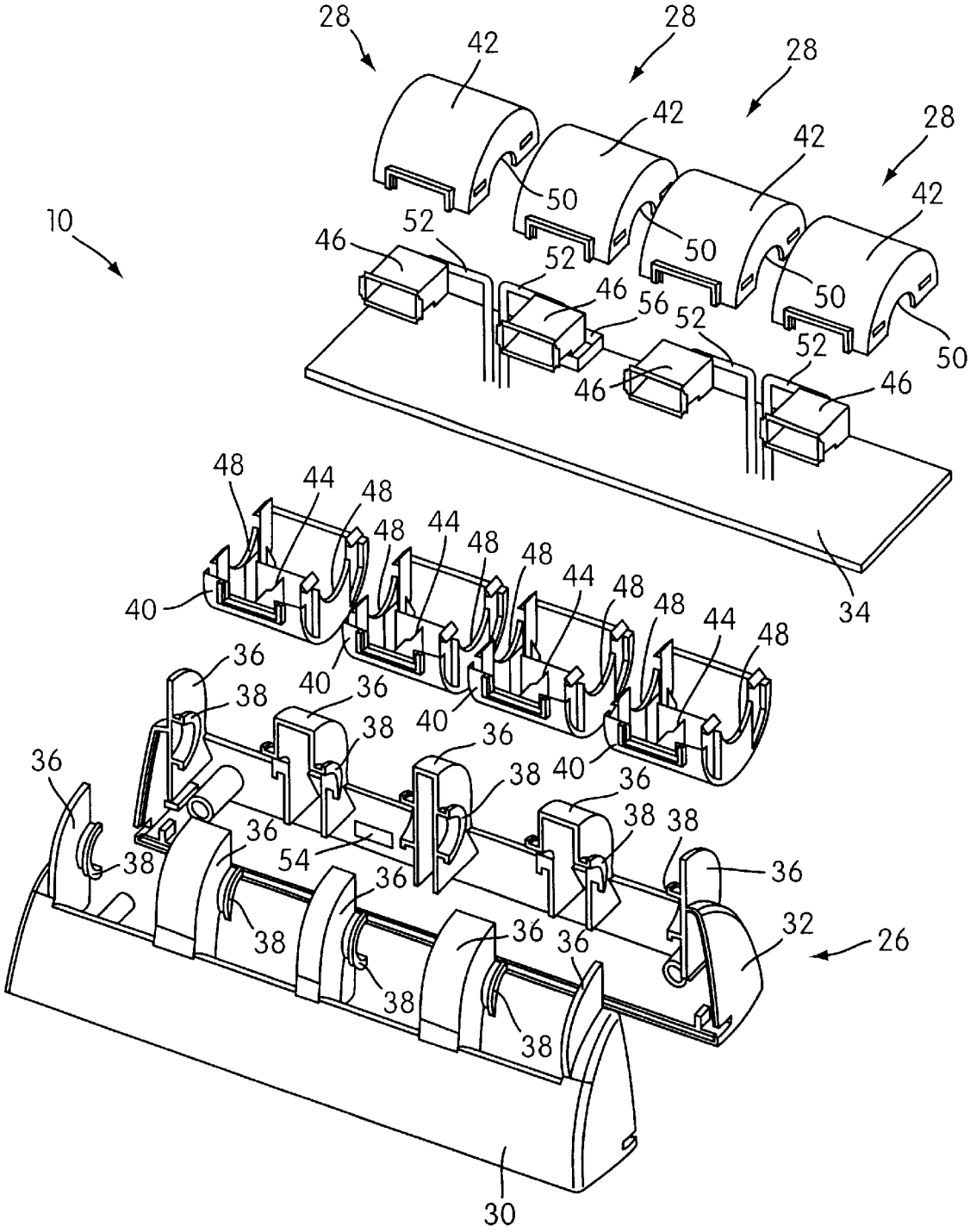
FIG. 3 is an exploded view of the device of FIG. 1.

Turning now to the structural configuration of the device 10, the device 10 comprises a housing 26 and a multiplicity of port orienting structures 28. As best seen in FIG. 3, the housing 26 is formed of two-molded plastic halves 30, 32 secured together in any suitable manner, such as by a snap-fit relation, adhesives, heat-staking, or fasteners. The hub 16 is provided by circuitry carried on a printed circuit board 34 that is fixedly mounted within the housing 26.

Each housing half 30, 32 has a series of partial mounting portions 36 extending upwardly therefrom. Each of these mounting portions 36 has an arcuate flange 38 provided thereon. The three central partial mounting portions each have a flange 38 on each side thereof and the outer mounting portions 36 each have a single flange 38 on the inner side thereof. When the housing halves, 30, 32 are secured together, the mounting portions 36 are engaged together.

The port orienting structures 28 are generally cylindrical and are each comprised of two semi-cylindrical halves 40, 42 that secure together in any suitable manner, such as by a snap-fit, adhesive, heat staking or fasteners. The interior of each port orienting structure 28 has ribs providing a seat 44 on which a plug receptacle 46 is mounted. The plug receptacle 46 faces outwardly through an opening 45. The end walls of each port orienting structure 28 have circular openings provided by semi-circular recesses 48, 50 on each half 40, 42, respectively. The upper halves 42 of the port orienting structures 28 also each have a seat (not shown) similar to seat 44 so that the plug receptacles 46 are restrained against movement within the orienting structures 28, thus remaining aligned with openings 45. Flexible connector cables 52 extend from the plug receptacles 46 out through the openings in the port orienting structures 28 and into the housing interior. The opposing ends of the flexible connector cables 52 connect to the printed circuit board 34.

Additionally, the circular openings pivotally mount the port orienting structures 28 to the flanges 38. Specifically, the housing halves 30, 32 are secured together with the lower halves 40 of the port orienting structures 28 inside its interior; then the plug receptacles 46 are seated on the seat 44 of the lower orienting structure halves 40; and then the upper halves 42 of the port orienting structures 28 are secured to the lower halves 40 with the flanges 38 received within the port orienting structures 28. As a result, the port orienting structures 38 can be individually moved relative to one another. Specifically, the orienting structures 28 can be individually pivoted relative to one another about a common axis. In the illustrated embodiment, the permitted range of pivotal movement is approximately 180°.

A longitudinal wall of the housing 26 has an opening 54 formed therein. A plug receptacle 56 is fixedly mounted to the printed circuit board 34 and faces outwardly through the opening 54. The plug receptacle 56 provides the upstream port 18 and is adapted to removably receive a plug on one end of a flexible cable 22 that removably connects by a plug (not shown) at its other end to a plug receptacle (not shown) associated with the root hub 13 of the host device 14. The upstream port 18 in plug receptacle 54 is provided by a plurality of contact elements that contact corresponding contact elements (not shown) inside the inserted plug. The contact elements in plug receptacle are electrically coupled to the printed circuit board to enable data to be transferred between the hub 16 and the host device 14 via the upstream port 18. The physical structure and arrangement of the plug receptacle 56, the plug inserted therein, and the arrangement of the contact elements is in accordance with well-known standards for devices operating on the USB protocol and is described in the above-referenced Universal Serial Bus Specifications.

Each of the plug receptacles 46 provides a downstream port 20 and is adapted to receive a plug on one end of a flexible cable 24 that also removably connects by a plug (not shown) at its other end to the plug receptacle of a peripheral device 12. Like the upstream port 18, the downstream port 20 in each plug receptacle 46 is provided by a plurality of contact elements (not shown) that contact corresponding contact elements (not shown) inside the inserted plug. These contact elements are electrically coupled to the printed circuit board 34 (i.e., the hub) by the flexible connector cables 52 inside the housing 26. As with the upstream port 20, the physical structure and arrangement of the plug receptacles 46, the plugs inserted therein, and the arrangement of the contact elements in accordance with well-known standards for devices operating on USB protocol.

The adjustability of the port orienting structures 28 facilitates connecting flexible cables from various peripheral devices 14, in different locations to the downstream ports 20. Specifically, the adjustability enables the user to aim the openings 45 in the respective general directions of the peripheral devices so that the plugs on the end of the flexible cables can be inserted into their respective openings 45 and plug receptacles 46 without having to significantly bend the cables or route them around the device 10 for connection with its associated receptacle 46.

The present invention is not limited to the construction illustrated. For example, the port orienting structures 28 could be provided by ball and socket-type structures that allow greater flexibility of movement. Additionally, one or more of the port orienting structures 28 may be provided with multiple downstream ports 18, instead of one as shown. Also, the upstream port 18 may also be provided on one of the port orienting structures 28 so as to enable its orientation to also be adjusted. In such an arrangement, the port orienting structure 28 with the upstream port 18 would be color-coded or labeled to facilitate identification. With respect to the hub 16, the protocol and operation of the hub 16 may have any configuration and the upstream and downstream ports may be of any suitable configuration for providing a point of access to the hub 16. Other suitable constructions or configurations may be envisioned.

The foregoing illustrative embodiment has been provided solely to illustrate the structural and functional principles of the present invention and is not intended to be limiting. To the contrary, the present invention is intended to encompass all modifications, substitutions, and alternations encompassed within the spirit and scope of the following claims.

What is claimed:

1. A multiple peripheral connection device for connecting multiple peripheral devices to a host device via a series of flexible electrical connectors, said device comprising:

a housing;

an upstream port adapted to be electrically connected to a flexible electrical connector that electrically connects to the host device so as to electrically couple said upstream port to the host device;

a plurality of downstream ports each adapted to be electrically connected to a flexible electrical connector that electrically connects to a peripheral device so as to electrically couple said downstream ports to the multiple peripheral devices;

a hub electrically coupling said upstream port to said downstream ports, said hub enabling data signals to be transferred between the host device and the multiple peripheral devices via said upstream port and said downstream ports; and a multiplicity of port orienting structures having said downstream ports provided thereon, said port orienting structures being individually movable relative to said housing and one another so as to enable relative orientations of said downstream ports provided thereon to be adjusted to facilitate establishing the electrical coupling between said downstream ports and the multiple peripheral devices via the flexible electrical connectors.

2. A multiple peripheral connection device according to claim 1, wherein said hub enables said data signals to be routed from the host device to a selected subset of the multiple peripheral device in accordance with the data transfer protocol.

3. A multiple peripheral connection device according to claim 2, wherein said hub enables said data signals to be transferred between the host device and the multiple peripheral devices in accordance with a serial data protocol.

4. A multiple peripheral connection device according to claim 3, wherein said hub enables said data signals to be transferred between the host device and the multiple peripheral devices in accordance with USB protocol.

5. A multiple peripheral connection device according to claim 3, wherein said hub enables said data signals to be transferred between the host device and the multiple peripheral devices in accordance with RS-232 protocol.

6. A multiple peripheral connection device according to claim 1, further comprising a multiplicity of flexible cables electrically coupling said downstream ports to said hub.

7. A multiple peripheral connection device according to claim 6, wherein said port orienting structures are individually pivotably mounted to said housing for individual pivotal movement.

8. A multiple peripheral connection device according to claim 7, wherein said port orienting structures are individually pivotably mounted to said housing for individual pivotal movement about a common pivot axis.

9. A multiple peripheral connection device according to claim 8, wherein said port orienting structures is movable through a range of positions which extends approximately 180 degrees with respect to said pivot axis.

10. A multiple peripheral connection device according to claim 1, wherein said housing is formed from molded plastic.

11. A multiple peripheral connection device according to claim 1, wherein said upstream port is fixed relative to said hub.

12. A multiple peripheral connection device according to claim 1, wherein each of said port orienting structures has only one of said downstream ports provided thereon so as to enable the relative orientations of said downstream ports provided thereon to be individually adjusted relative to one another.

13. A multiple peripheral connection device according to claim 4, further comprising a multiplicity of flexible cables electrically coupling said downstream ports to said hub.

14. A multiple peripheral connection device according to claim 13, wherein said port orienting structures are individually pivotably mounted to said housing for individual pivotal movement.

15. A multiple peripheral connection device according to claim 14, wherein said port orienting structures are individually pivotably mounted to said housing for individual pivotal movement about a common pivot axis.

16. A multiple peripheral connection device according to claim 15, wherein said port orienting structures is movable through a range of positions which extends approximately 180 degrees with respect to said pivot axis.

17. A multiple peripheral connection device according to claim 4, wherein said housing is formed from molded plastic.

18. A multiple peripheral connection device according to claim 4, wherein said upstream port is fixed relative to said hub.

19. A multiple peripheral connection device according to claim 4, wherein each of said port orienting structures has only one of said downstream ports provided thereon so as to enable the relative orientations said downstream ports provided thereon to be individually adjusted relative to one another.

20. A system comprising:

a host device;

multiple peripheral devices;

flexible electrical connectors electrically connected to each of said multiple peripheral devices and said host device;

a multiple peripheral connection device comprising:

a housing;

an upstream port electrically connected to the flexible electrical connector that electrically connects to the host device so as to electrically couple said upstream port to the host device;

a plurality of downstream ports electrically connected to the flexible electrical connectors that electrically connect to the multiple peripheral devices so as to electrically couple said downstream ports to the multiple peripheral devices;

a hub electrically coupling said upstream port to said downstream ports, said hub enabling data signals to be transferred between the host device and the multiple peripheral devices via said upstream port and said downstream ports; and a multiplicity of port orienting structures having said downstream ports provided thereon, said port orienting structures being individually movable relative to said housing and one another so as to enable relative orientations of said downstream ports provided thereon to be adjusted to facilitate establishing the electrical coupling between said downstream ports and said multiple peripheral devices via the flexible electrical connectors.

21. A system according to claim 20, wherein said hub enables said data signals to be routed from the host device to a selected subset of the multiple peripheral device in accordance with a data transfer protocol.

22. A system according to claim 21, wherein said hub enables said data signals to be transferred between the host device and the multiple peripheral devices in accordance with a serial data protocol.

23. A system according to claim 22, wherein said hub enables said data signals to be transferred between the host device and the multiple peripheral devices in accordance with USB protocol.

24. A system according to claim 22, wherein said hub enables said data signals to be transferred between the host device and the multiple peripheral devices in accordance with RS-232 protocol.

25. A system according to claim 20, wherein said multiple connection device further comprises a multiplicity of flexible cables electrically coupling said downstream ports to said hub.

26. A system according to claim 25, wherein said port orienting structures are individually pivotably mounted to said housing for individual pivotal movement.

27. A system according to claim 26, wherein said port orienting structures are individually pivotably mounted to said housing for individual pivotal movement about a common pivot axis.

28. A system according to claim 27, wherein said port orienting structures is movable through a range of positions which extends approximately 180 degrees with respect to said pivot axis.

29. A system according to claim 20, wherein said housing is formed from molded plastic.

30. A system according to claim 20, wherein said upstream port is fixed relative to said hub.

31. A system according to claim 20, wherein each of said port orienting structures has only one of said downstream ports provided thereon so as to enable the relative orientations said downstream ports provided thereon to be individually adjusted relative to one another.

32. A system according to claim 23, wherein said multiple electrical connection device further comprises a plurality of flexible cables electrically coupling said downstream ports to said hub.

33. A system according to claim 32, wherein said port orienting structures are individually pivotably mounted to said housing for individual pivotal movement.

34. A system according to claim 33, wherein said port orienting structures are individually pivotably mounted to said housing for individual pivotal movement about a common pivot axis.

35. A system according to claim 34, wherein said port orienting structures is movable through a range of positions which extends approximately 180 degrees with respect to said pivot axis.

36. A system according to claim 23, wherein said housing is formed from molded plastic.

37. A system according to claim 23, wherein said upstream port is fixed relative to said hub.

38. A system according to claim 23, wherein each of said port orienting structures has only one of said downstream ports provided thereon so as to enable the relative orientations said downstream ports provided thereon to be individually adjusted relative to one another.

* * * * *